US009968862B2

(12) United States Patent
Feng

(10) Patent No.: US 9,968,862 B2
(45) Date of Patent: May 15, 2018

(54) INTERACTIVE DOLL AND A METHOD TO CONTROL THE SAME

(71) Applicant: Tencent Technology (Shenzhen) Co., Ltd., Shenzhen, Guangdong (CN)

(72) Inventor: Yanni Feng, Guangdong (CN)

(73) Assignee: Tencent Technology (Shenzhen) Company Limited, Shenzhen (CN)

( * ) Notice: Subject to any disclaimer, the term of this patent is extended or adjusted under 35 U.S.C. 154(b) by 0 days. days.

(21) Appl. No.: 15/105,442

(22) PCT Filed: Jan. 28, 2015

(86) PCT No.: PCT/CN2015/071775
§ 371 (c)(1),
(2) Date: Jun. 16, 2016

(87) PCT Pub. No.: WO2015/176555
PCT Pub. Date: Nov. 26, 2015

(65) Prior Publication Data

US 2016/0310855 A1 Oct. 27, 2016

(30) Foreign Application Priority Data

May 21, 2014 (CN) ..... 2014 1 0216896

(51) Int. Cl.
*A63H 3/36* (2006.01)
*A63H 30/04* (2006.01)
*A63H 3/28* (2006.01)

(52) U.S. Cl.
CPC ..... *A63H 3/36* (2013.01); *A63H 3/28* (2013.01); *A63H 30/04* (2013.01)

(58) Field of Classification Search
None
See application file for complete search history.

(56) References Cited

U.S. PATENT DOCUMENTS 6,200,193 B1 * 3/2001 Nadel ..... A63H 5/00 446/397
6,285,924 B1 * 9/2001 Okamoto ..... G01C 21/3629 701/1

(Continued)

FOREIGN PATENT DOCUMENTS

CN 2140252 Y 8/1993
CN 201216881 Y 4/2009

(Continued)

OTHER PUBLICATIONS

International Search Report and Written Opinion received in PCT Application No. PCT/CN2015/071775 dated Apr. 24, 2015.

(Continued)

*Primary Examiner* — Tramar Harper
(74) *Attorney, Agent, or Firm* — Brinks Gilson & Lione

(57) ABSTRACT

The present disclosure discloses an interactive doll, and an interactive doll control method, wherein, the method includes the following operations: monitoring a control mode selected by a user for controlling the interactive doll; if the selected control mode being a voice control mode, obtaining a voice control instruction, wherein the voice control instruction contains one or more keyword voice segment as input control command to control the interactive doll; obtaining voice control information corresponding to the keyword voice segment, and executing an operation corresponding to the voice control information. The controlling method and the interactive doll may provide more responsiveness and improved user's experience in virtual reality.

13 Claims, 5 Drawing Sheets

(56) References Cited

U.S. PATENT DOCUMENTS 6,415,439 B1 * 7/2002 Randell ..... H04L 67/12 348/61
6,544,094 B1 * 4/2003 Maddocks ..... A63H 3/48 446/175
6,661,239 B1 * 12/2003 Ozick ..... G01D 5/2405 324/658
2001/0027397 A1 * 10/2001 Yeon ..... G09B 5/04 704/272
2001/0041496 A1 * 11/2001 Smirnov ..... A63H 3/28 446/297
2002/0042713 A1 * 4/2002 Kim ..... G10L 15/28 704/272
2002/0049877 A1 * 4/2002 Lin ..... G06F 13/385 710/305
2002/0077028 A1 * 6/2002 Nishimoto ..... A63H 30/04 446/484
2004/0119342 A1 * 6/2004 Sato ..... G01D 5/24 307/652
2006/0068366 A1 * 3/2006 Chan ..... A63H 3/52 434/169
2009/0156089 A1 * 6/2009 Hoard ..... A63H 3/001 446/297
2009/0209170 A1 * 8/2009 Richter ..... A63H 3/28 446/297
2011/0065354 A1 * 3/2011 Wolfe ..... A63H 3/001 446/297

FOREIGN PATENT DOCUMENTS

CN 201470124 U 5/2010
CN 104138665 A 11/2014
JP 2002066155 A 3/2002

OTHER PUBLICATIONS

First Office Action received in Chinese Application No. CN201410216896.7 dated Jul. 2, 2015.
Summary of First Office Action received in Chinese Application No. CN201410216896.7 dated Jul. 2, 2015.

* cited by examiner

INTERACTIVE DOLL AND A METHOD TO CONTROL THE SAME

CROSS-REFERENCE TO RELATED APPLICATIONS

This application is filed under 35 U.S.C. § 371 out of PCT Application No. PCT/CN2015/071775, filed on Jan. 28, 2015, which claims priority to Chinese Patent Application No. 201410216896.7, filed on May 21, 2014, both are incorporated by reference in their entirety.

FIELD OF THE TECHNOLOGY

The present disclosure relates to the field of computer technologies, particularly to an interactive doll, and a method to control the same.

BACKGROUND

Dolls are toys made to entertain people, especially children. Dolls which are made to impersonate a human or a pet may provide certain degrees of satisfaction for virtual companionship. Sophisticated dolls may be made with materials and more details to closely resemble the real object may provide a sense of warmth and comfort when being handled, nevertheless, a lack of ability to interact and respond back to human still cannot fulfill a sense of reality.

Technology provides limited doll interactions to respond to human's touch. For example, some dolls are made to include an acoustical generator, which produces sounds or speech when being pressed. However, the sound and speech patterns are quite routine and repetitive; therefore the interactive experience may be monotonous and lack reality perceptions.

SUMMARY

The embodiments of the present disclosure provide an interactive doll control method and an interactive doll that may be more responsive and with improved virtual reality perceptions.

To solve the above-mentioned technical problem, a first aspect of embodiments of the present disclosure provides an interactive doll control method, which includes at least the following operations: monitoring a control mode selected by a user for controlling the interactive doll; if the selected control mode being a voice control mode, obtaining a voice control instruction, wherein the voice control instruction contains one or more keyword voice segment as input control command to control the interactive doll; obtaining voice control information corresponding to the keyword voice segment, and executing an operation corresponding to the voice control information.

A second aspect of the embodiments of the present disclosure provides an interactive doll, which includes: a doll figure featured with relevant body areas, wherein more than one featured relevant body areas are controlled by at least one processor with circuitry, operating in conjunction with at least a memory storing codes as a plurality of modules and units, wherein the plurality of modules and units are executed by the at least one processor with circuitry to perform interactive doll control functions, wherein the plurality of modules and units include: a mode monitoring unit, configured to monitor a control mode selected by a user for controlling the interactive doll; an instruction acquisition unit, configured to, when the mode monitoring unit detects that the selected control mode being a voice control mode, obtain a voice control instruction, wherein the voice control instruction contains one or more keyword voice segment as input control command to control the interactive doll; an information acquisition and execution unit, configured to obtain voice control information corresponding to the keyword voice segment, and execute an operation corresponding to the voice control information.

The above disclosed embodiments of interactive dolls provide a user with a choice of control mode using one of both of: voice command and touch command. In addition, the acquisition of voice control information corresponding to a keyword voice segment in the voice control mode may enable more diversified interactive operations; therefore enhancing customer experience.

BRIEF DESCRIPTION OF THE DRAWINGS

The accompanying drawings may be included to provide further understanding of the claims and disclosure which may be incorporated in, and constitute an area of this specification. The detailed description and illustrated embodiments described may serve to explain the principles defined by the claims.

DETAILED DESCRIPTION OF ILLUSTRATED EMBODIMENTS

The various embodiments of the disclosure may be further described in details in combination with attached drawings and embodiments below. It should be understood that the specific embodiments described here may be used only to explain the disclosure, and may not be configured to limit the disclosure. In addition, for the sake of keeping description brief and concise, the newly added features, or features which may be different from those previously described in each new embodiment may be described in details. Similar features may be referenced back to the prior descriptions in a prior numbered drawing or referenced ahead to a higher numbered drawing. Unless otherwise specified, all technical and scientific terms herein may have the same meanings as understood by a person skilled in the art.

The interactive doll control methods disclosed by the various embodiments of the present disclosure may find scenarios in common dolls constructed from a materials including but not limited to: cloth dolls, wooden dolls, plastic dolls, silicone dolls, rubber dolls, inflatable dolls, metallic dolls or dolls made from a combination of the above mentioned materials.

Most commonly, the interactive dolls may be made to fulfill the demand of children's toys, as a virtual companion virtual playmate, surrogate parent, virtual child, virtual baby, or a virtual pet. Interactive dolls may also be made to perform labor chores such as a virtual helper, a virtual nanny, a virtual security guard, virtual assistant, etc. Furthermore, there has been a growing demand in the adult sex toys market for dolls which may be able to respond and interact to one or both of selected voice command mode and touch mode, to fulfill certain fantasies and enhance sexual pleasures as virtual human substitutes.

For example, a user may select one or both of: a voice control mode or a touch mode for an interactive doll. Upon monitoring that the voice control mode may be detected, the interactive doll may obtain a voice control instruction, wherein the voice control instruction contains one or more keyword voice segment as input control command to control the interactive doll; and the interactive doll may obtain voice control information corresponding to the keyword voice segment, and executing an operation corresponding to the voice control information.

The keyword voice segment may be a keyword or a key sentence captured from a voice input which be a speech segment spoken by the user which may capture the keyword "laugh" in the phrase "laugh loud". The keyword voice segment may also be a user-input complete voice, which may be a voice control instruction generated to encapsulate the user-input voice. Alternately, the, user-input voice may simply be a detection of a distinguished pattern of speech expression including detecting of a voice volume of a detected laughing voice or a detected expression of excitement (e.g., scream, shout, laugh, etc.).

Figure 5:
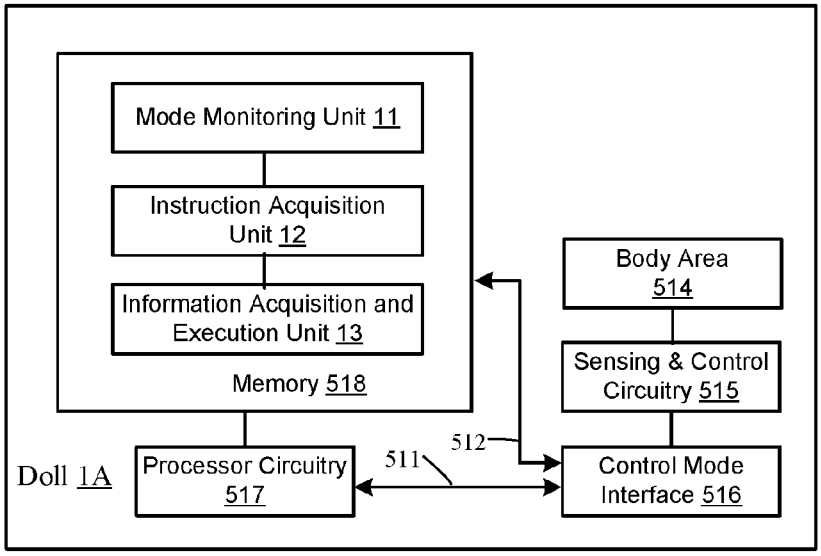
FIG. 5 shows an exemplary structural diagram of an interactive doll, according to an embodiment of the present disclosure.
Figure 6:
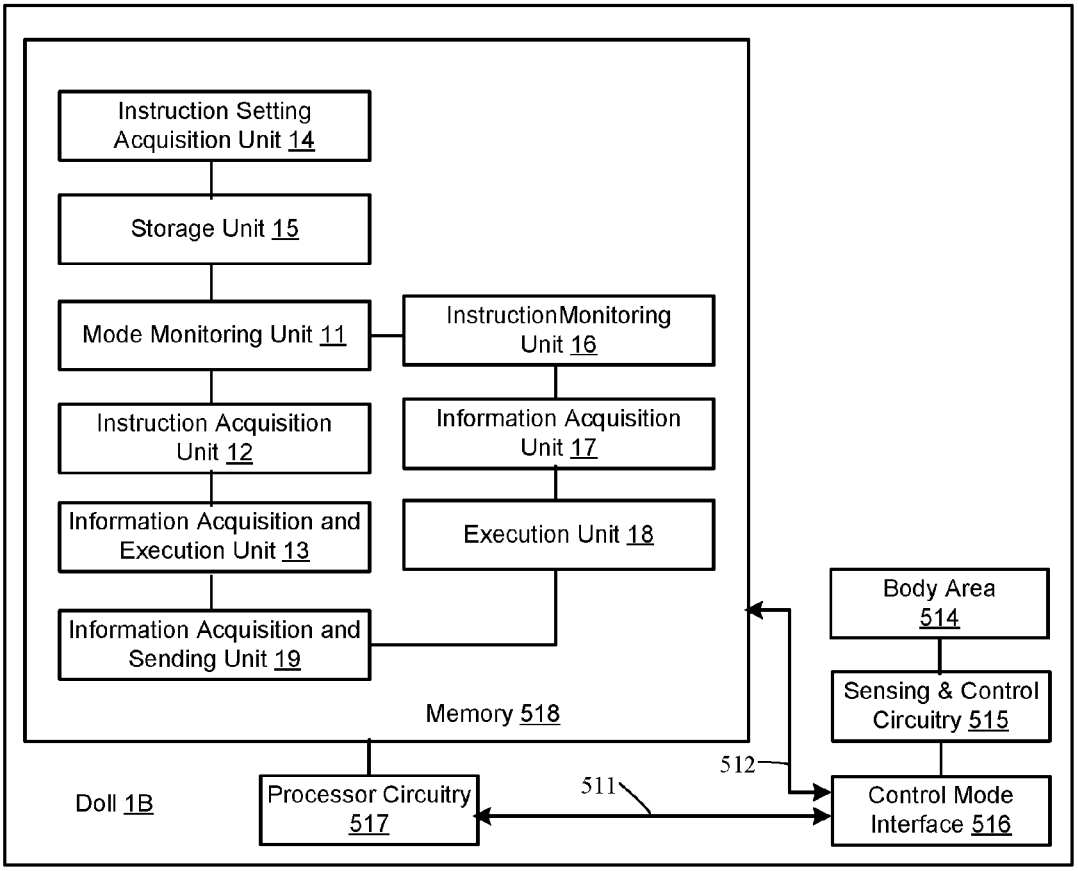
FIG. 6 shows an exemplary structural diagram of an interactive doll, according to another embodiment of the present disclosure.

FIGS. 1 to 4 may be utilized in conjunction to illustrate the various embodiments of an interactive doll control method. FIGS. 5 and 6 may be utilized in area to illustrate an exemplary structural diagram of an interactive doll (see 1A and 1B in FIG. 5), according to respective embodiments of the present disclosure.

Figure 1:
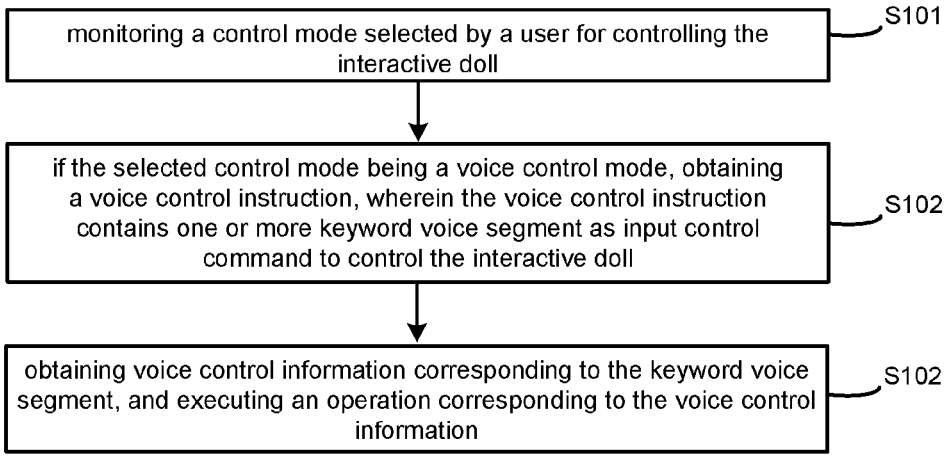
FIG. 1 shows a flowchart of an exemplary method of controlling an interactive doll, according to an embodiment of the present disclosure.

FIG. 1 shows a flowchart of an exemplary method of controlling an interactive doll (1A), according to an embodiment of the present disclosure. As shown in FIG. 1, the method for controlling an interactive doll may include at least Steps S101 to S103.

S101: Monitoring a control mode selected by a user for controlling the interactive doll (1A). More specifically, an interactive doll may monitor in real time the control mode selected by the user for the interactive doll (1A). Preferably, the interactive doll may be equipped with at least a control mode conversion interface (516) which obtains detected signals from a sensing and control circuitry (515) which senses received input signals from a user, such as voice commands or tactile signals through touching a relevant body area (514). By monitoring the control mode conversion interface (516) in real time, the interactive doll (1A) may obtain the control mode selected by the user. The control mode conversion interface (516) may be a physical button, a touchscreen, or a voice interface.

It may be pointed out that, before the step of monitoring the control mode selected by the user for the interactive doll, the interactive doll (1A) may obtain at least one control instruction set (511) corresponding to at least one piece of control information configured in the interactive doll. The control instruction set (511) being one or both of: the voice control instruction and the touch control instruction.

The control information may contain a control signal (511) intended for the interactive doll, and a specific body area (514) on the interactive doll (1A) may execute the control signal. For each body area or control signal of the interactive doll, a user may define the corresponding control instruction. For example, the control instruction that instructs an interactive doll to emit sounds of laughter may be set to the voice control instruction "laugh"; the control instruction that instructs an interactive doll to put up arms may be set to the touch control instruction "Caress the interactive doll's head." The interactive doll stores the at least one control instruction and the at least one piece of control information.

It may be understood that, in the voice control mode, the interactive doll responds to voice control instructions only; in the touch mode, the interactive doll responds to touch control instructions only; in the voice control and touch mode, the interactive doll may respond to voice control instructions and touch control instructions. Control mode selection may meet users' individual needs. In addition, in the voice control mode or touch mode, power may be stored.

S102: If the selected control mode being a voice control mode, obtain a voice control instruction containing a keyword voice segment and input in the interactive doll;

Specifically, on detecting that the control mode selected by the user may be the voice control mode, the interactive doll obtains the voice control instruction containing a keyword voice segment and input in the interactive doll.

S103: Obtain the voice control information corresponding to the keyword voice segment, and execute the operation corresponding to the control information.

Specifically, the interactive doll obtains the voice control information corresponding to the keyword voice segment. The at least one piece of control information may contain a control signal which executes an operation to control a corresponding specific body area (514) (such as hand, arm, shoulder, face) on the interactive doll. The interactive doll may instruct the corresponding specific body area (514) of the interactive doll to respond by executing the operation corresponding to the control signal. In the voice control mode, the operations corresponding to the control signal may include making specified sounds, analyzing the voice control instruction and then carrying out a conversation, or respond by executing certain specified physical operations (e.g., waving an arm, turning the head, twisting the waist, and changing a position, etc.).

Preferably, the interactive doll may obtain feedback information (512) generated according to a status of the executed operation corresponding to one or both of: the voice control information and the touch control information, which the interactive doll may generate to notify the user.

In an embodiment of the present disclosure, the interactive doll upon detecting that the control mode the user selects for the interactive doll may be the voice control mode, obtains the input voice control instruction containing the keyword voice segment, obtains voice control information corresponding to the keyword voice segment, and executes an operation corresponding to the voice control information. Control mode selection improves doll operability. Acquisition of voice control information corresponding to the keyword voice segment in the voice control mode enables more diversified interactive operations. In addition, the feedback information (512) output further improves the interaction experience with the interactive doll.

Figure 2:
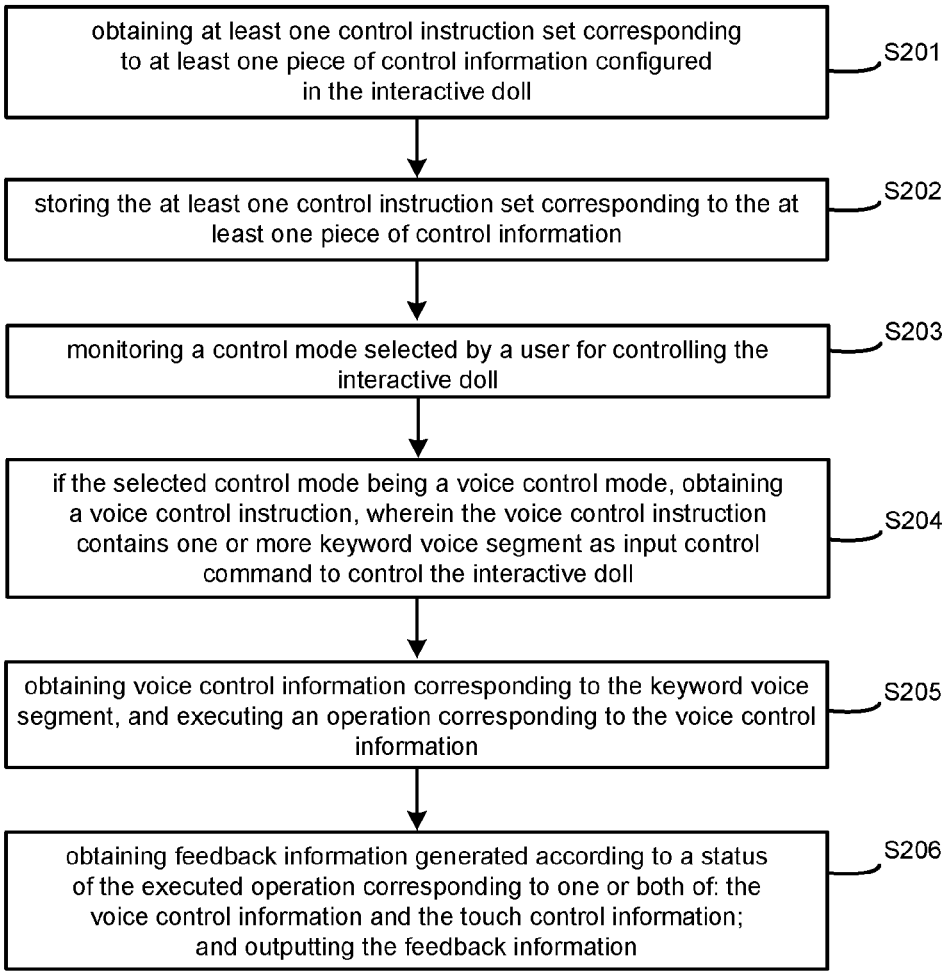
FIG. 2 shows a flowchart of an exemplary method of controlling an interactive doll, according to another embodiment of the present disclosure.

Referring to FIG. 2, which shows a doll control method according to another embodiment of the present disclosure. The control mode selected by the user may be the voice control mode, which may include at least Steps S201 to S206, where step 203 to step 205 are similar to steps 101 to 103 in FIG. 1.

S201: obtaining at least one control instruction set corresponding to at least one piece of control information configured in the interactive doll.

S202: storing the at least one control instruction set corresponding to the at least one piece of control information.

Specifically, the interactive doll (1B) in FIG. 6 may obtain at least one control instruction set corresponding to at least one piece of control information in the interactive doll, which the control instruction set being one or both of: the voice control instruction and the touch control instruction. The control information may contain a control signal (511) intended to interact with the interactive doll's body area (514) which executes the control signal (511). For each respective body area (514) and a corresponding control signal (511) of the interactive doll (1B), the user may define a corresponding control instruction. For example, a control instruction which instructs an interactive doll to make laughter sounds may be set by the user to a voice control instruction of "laugh"; and a control instruction which instructs an interactive doll to raise an arm may be set to respond to a touch control instruction of "Caress the interactive doll's head." The interactive doll (1B) may store the at least one control instruction and the at least one piece of control information.

It may be understood that, in the voice control mode, the interactive doll may respond to voice control instructions only; and in the touch mode, the interactive doll may respond to touch control instructions only. If in both the voice control and touch mode, the interactive doll may respond to both voice control instructions and touch control instructions. Control mode selection may meet users' individual needs, and thus conserve power consumption.

Steps S203 to S205 are similar to steps S101 to S103, the reader is referred to the above description in the corresponding steps.

S206: obtaining feedback information (512) generated according to a status of the executed operation corresponding to one or both of: the voice control information and the touch control information; and outputting the feedback information.

Specifically, feedback information (512) may be generated by the interactive doll (1B) on the basis of the status of the operation corresponding to the control information. The feedback information (512) may be out put to the user to notify the user of the current status of the interactive doll.

In an embodiment of the present disclosure, the interactive doll upon detecting that the control mode the user selects for the interactive doll may be the voice control mode, obtains the input voice control instruction containing the keyword voice segment, obtains voice control information corresponding to the keyword voice segment, and executes an operation corresponding to the voice control information. Control mode selection improves doll operability. Acquisition of voice control information corresponding to the keyword voice segment in the voice control mode enables more diversified interactive operations. In addition, the feedback information (512) output further improves the interaction experience with the interactive doll.

Figure 3:
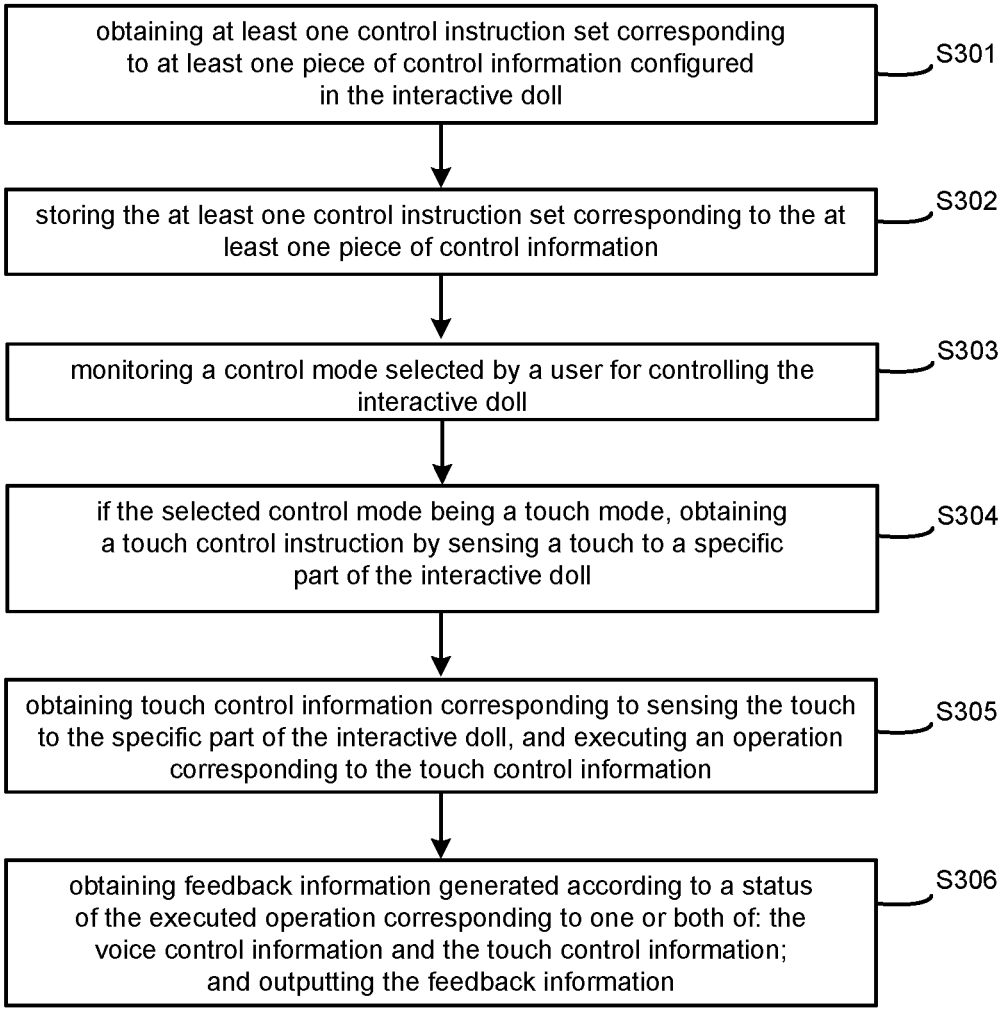
FIG. 3 shows a flowchart of an exemplary method of controlling an interactive doll, according to yet another embodiment of the present disclosure.

FIG. 3 shows a flowchart of another doll control method provided by another embodiment of the present disclosure. The method may be applicable to the touch control mode selected by the user with at least the following Steps S301 to S306.

Steps S301-S302 is similar to steps S201 to S202, the reader is referred to the above description in the corresponding steps.

Step S303 is similar to step S101, the reader is referred to the above description in the corresponding step. More specifically, an interactive doll may monitor in real time the control mode selected by the user for the interactive doll (1A). Preferably, the interactive doll may be equipped with at least a control mode conversion interface (516) which obtains detected signals from a sensing and control circuitry (515) which senses received input signals from a user, such as voice commands or tactile signals through touching a relevant body area (514). By monitoring the control mode conversion interface (516) in real time, the interactive doll (1A) may obtain the control mode selected by the user. The control mode conversion interface (516) may be a physical button, a touchscreen, or a voice interface.

S304: if the selected control mode being a touch mode, obtaining a touch control instruction by sensing a touch to a specific body area of the interactive doll. Specifically, upon detecting that the control mode selected by the user may be the touch mode, the interactive doll may obtain the touch control instruction sensing a touch to a specific body area of the interactive doll.

S305: obtaining touch control information (i.e., signal (511)) corresponding to sensing the touch (i.e., through sensing and control circuitry (515)) to the specific body area (514) of the interactive doll (1B), and executing an operation corresponding to the touch control information.

Specifically, the interactive doll may obtain voice control information corresponding to the specific touched body area (514). The at least one piece of control information contains a control signal (511) which executes an operation to control a corresponding specific body area (514) on the interactive doll (1B). The interactive doll may instruct the interactive body area (514) to execute the operation corresponding to the control signal (511).

In the touch mode, the operations corresponding to the control signal (514) include making specified sounds (for example, if the interactive doll's head may be touched, making sounds indicating shyness), performing the specified action (for example, waving an arm, twisting the waist, and changing a position), and warming an interactive body area (if an arm is touched).

It may be understood that a touched area of the interactive doll may be equipped with certain sensors (i.e., sensors in the sensing and control circuitry (515)), such as a temperature sensor, tactile sensor, pressure sensor, velocity sensor, humidity sensor, and gas sensor. Based on these sensors, the interactive doll may detect the body area (514) currently being touched by the user and obtain a current status of the user. For example, a gas sensor on the interactive doll (1B) may detect some odor of alcohol on the user, and therefore speak a sentence such as "stop drinking" or "enough, no more drinks".

In an embodiment, the touched specific body area (514) and the body area which responds to the touch sensor may be different areas. For example, when the head area of the interactive doll is touched (i.e., the sensor of the head detects a touch); the interactive doll's arms and waist (which are different body areas from the head area which is being touched) may be instructed to respond by performing the specified actions (such as moving the arms or the waist). Response adjustments may be made based on the instruction settings in the flow chart.

S306: obtaining feedback information (512) generated according to a status of the executed operation corresponding to one or both of: the voice control information and the touch control information; and outputting the feedback information.

Specifically, feedback information (512) may be generated by the interactive doll (1B) on the basis of the status of the operation corresponding to the control information. The feedback information (512) may be out put to the user to notify the user of the current status of the interactive doll.

In the embodiments of the present disclosure, the interactive doll upon detecting that the control mode the user selects for the interactive doll may be the voice control mode, obtains the input voice control instruction containing the keyword voice segment, obtains voice control information corresponding to the keyword voice segment, and executes an operation corresponding to the voice control information. Control mode selection improves doll operability. Acquisition of voice control information corresponding to the keyword voice segment in the voice control mode enables more diversified interactive operations. In addition, the feedback information (512) output further improves the interaction experience with the interactive doll.

Figure 4:
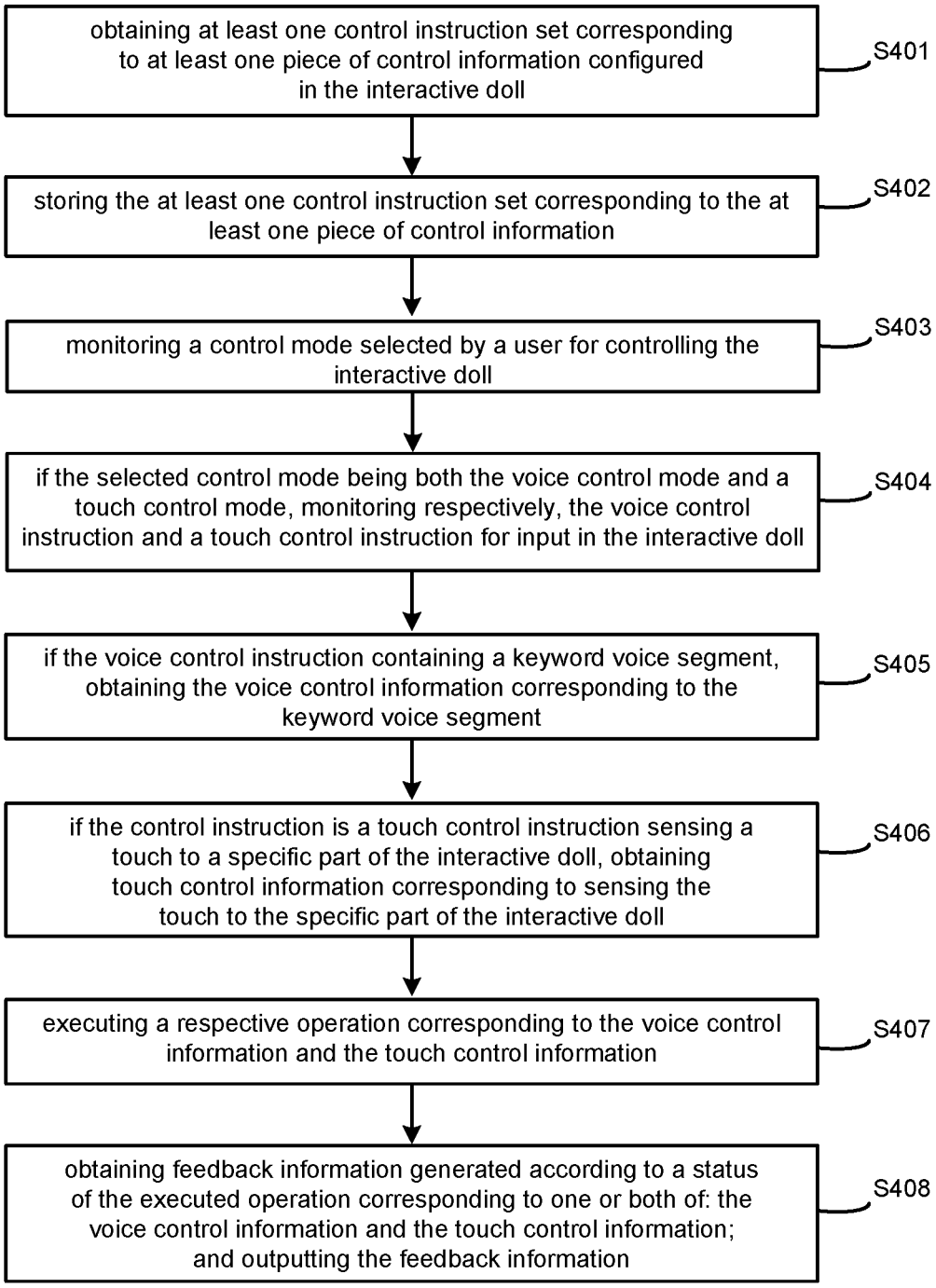
FIG. 4 shows a flowchart of an exemplary method of controlling an interactive doll, according to yet another embodiment of the present disclosure.

FIG. 4 shows a flowchart of another doll control method provided when the control mode selected by the user for an interactive doll include both the voice control mode and the touch control mode. The method includes at least Steps S401 to S408.

Steps S401-402 are similar to steps S201 to S202, the reader is referred to the above description in the corresponding steps.

S403: Monitor the control mode that the user selects for an interactive doll;

More specifically, an interactive doll may monitor in real time the control mode selected by the user for the interactive doll (1A). Preferably, the interactive doll may be equipped with at least a control mode conversion interface (516) which obtains detected signals from a sensing and control circuitry (515) which senses received input signals from a user, such as voice commands or tactile signals through touching a relevant body part (514). By monitoring the control mode conversion interface (516) in real time, the interactive doll (1A) may obtain the control mode selected by the user. The control mode conversion interface (516) may be a physical button, a touchscreen, or a voice interface. By using the conversion interface (516), a user may select a control mode for the interactive doll (1B).

S404: if the selected control mode being both the voice control mode and a touch control mode, monitoring respectively, the voice control instruction and a touch control instruction for input in the interactive doll.

Specifically, upon detecting that the control mode selected by the user being both voice control mode and touch control mode, the interactive doll further monitors the control instruction input in the interactive doll.

S405: if the voice control instruction containing a keyword voice segment, obtaining the voice control information corresponding to the keyword voice segment.

Specifically, if the voice control instruction containing a keyword voice segment, the interactive doll obtains the voice control instruction containing a keyword voice segment and input in the interactive doll, and obtain the voice control information corresponding to the keyword voice segment.

S406: if the control instruction is a touch control instruction sensing a touch to a specific body part of the interactive doll, obtaining touch control information corresponding to sensing the touch to the specific body part of the interactive doll.

Specifically, if the control instruction may be a touch control instruction sensing a touch to a specific body area of the interactive doll, the interactive doll may obtain the touch control instruction containing the touched area (514) of the interactive doll, and obtain the voice control information corresponding to the touched area (514);

S407: executing a respective operation corresponding to the voice control information and the touch control information.

Specifically, the interactive doll may obtain voice control information corresponding to the specific touched body area (514). The at least one piece of control information contains a control signal (511) which executes an operation to control a corresponding specific body area (514) on the interactive doll (1B). The interactive doll may instruct the interactive body area (514) to execute the operation corresponding to the control signal (511).

After the control information corresponding to a keyword voice segment may be received, the operations corresponding to the control signal include making specified sounds, analyzing the voice control instruction and carrying out a conversation, and performing specified actions, for example, waving an arm, twisting the waist, and changing a position.

In the touch mode, the operations corresponding to the control signal (514) include making specified sounds (for example, if the interactive doll's head may be touched, making sounds indicating shyness), performing the specified action (for example, waving an arm, twisting the waist, and changing a position), and warming an interactive body area (if an arm is touched).

It may be understood that a touched area of the interactive doll may be equipped with certain sensors (i.e., sensors in the sensing and control circuitry (515)), such as a temperature sensor, tactile sensor, pressure sensor, velocity sensor, humidity sensor, and gas sensor. Based on these sensors, the interactive doll may detect the body area (514) currently being touched by the user and obtain a current status of the user. For example, a gas sensor on the interactive doll (1B) may detect some odor of alcohol on the user, and therefore speak a sentence such as "stop drinking" or "enough, no more drinks".

In an embodiment, the touched specific body area (514) and the body area which responds to the touch sensor may be different areas. For example, when the head area of the interactive doll is touched (i.e., the sensor of the head detects a touch); the interactive doll's arms and waist (which are different body areas from the head area which is being touched) may be instructed to respond by performing the specified actions (such as moving the arms or the waist). Response adjustments may be made based on the instruction settings in the flow chart.

S408: Obtain the feedback information generated on the basis of the status of the operation corresponding to the control information, and output the feedback information;

Specifically, the interactive doll may obtain the feedback information that the interactive doll generates on the basis of the status of the operation corresponding to the control information and output the feedback information, notifying the user of the current status of the interactive doll.

In the embodiments of the present disclosure, an interactive doll, on detecting that the control mode that the user selects for the interactive doll being both voice control mode and touch control mode, may obtain the corresponding control information based on the voice control instruction or touch control instruction preset by the user and execute the operation corresponding to the control information. Users are allowed to set control instructions themselves, meeting the users' individual needs. Control mode selection improves doll operability. Concurrent application of a voice control instruction and a touch control instruction makes the operations more diversified. In addition, feedback information (512) output further improves interaction with the doll (1B), thereby enhancing customer experience.

FIG. 5 to FIG. 6 are described in conjunction, which illustrates an exemplary structure of the respective interactive dolls (1A, 2B). Note that the interactive dolls (1A, 1B) as shown in FIG. 5 and FIG. 6 are configured to execute the methods provided by the present disclosure as shown in FIG. 1 to FIG. 4. For convenience of description, only relevant operations related to the embodiments of the present disclosure may be described.

The interactive doll (1A) in FIG. 5 include relevant body areas, wherein more than one featured relevant body areas (514) are controlled by at least one processor with circuitry (517), operating in conjunction with at least a memory (518) storing codes as a plurality of modules and units. The plurality of modules and units include: a mode monitoring unit (11), an instruction acquisition unit (12) and an information acquisition and execution unit (13).

The mode monitoring unit (11) may be configured to monitor a control mode selected by a user for controlling the interactive doll (1A). In actual implementation, the mode monitoring unit (11) may monitor in real time the control mode selected by the user for the interactive doll (1A). Preferably, the interactive doll may be equipped with at least a control mode conversion interface (516) which obtains detected signals from a sensing and control circuitry (515) which senses received input signals from a user, such as voice commands or tactile signals through touching a relevant body part (514). By monitoring the control mode conversion interface (516) in real time, the interactive doll (1A) may obtain the control mode selected by the user. The control mode conversion interface (516) may be a physical button, a touchscreen, or a voice interface.

It may be pointed out that, before the step of monitoring the control mode selected by the user for the interactive doll, the interactive doll (1A) may obtain at least one control instruction set (511) corresponding to at least one piece of control information configured in the interactive doll. The control instruction set (511) being one or both of: the voice control instruction and the touch control instruction.

The control information may contain a control signal (511) intended for the interactive doll, and a specific body part (514) on the interactive doll (1A) may execute the control signal. For each body part or control signal of the interactive doll, a user may define the corresponding control instruction. For example, the control instruction that instructs an interactive doll to emit sounds of laughter may be set to the voice control instruction "laugh"; the control instruction that instructs an interactive doll to put up arms may be set to the touch control instruction "Caress the interactive doll's head." The interactive doll stores the at least one control instruction and the at least one piece of control information.

It may be understood that, in the voice control mode, the interactive doll responds to voice control instructions only; in the touch mode, the interactive doll responds to touch control instructions only; in the voice control and touch mode, the interactive doll may respond to voice control instructions and touch control instructions. Control mode selection may meet users' individual needs. In addition, in the voice control mode or touch mode, power may be stored.

The instruction acquisition unit (12) may be configured to monitor a control mode selected by a user for controlling the interactive doll. In actual implementation, when the mode monitoring unit (11) detects that the control mode selected by the user may be the voice control mode, the instruction acquisition unit (12) may obtain a voice control instruction containing a keyword voice segment and input in the interactive doll (1A).

The information acquisition and execution unit (13) may be configured to obtain voice control information corresponding to the keyword voice segment, and execute an operation corresponding to the voice control information.

In actual implementation, the information acquisition and execution unit (13) may obtain the voice control information corresponding to the keyword voice segment. The at least one piece of control information may contain a control signal which executes an operation to control a corresponding specific body part (514) (such as hand, arm, shoulder, face) on the interactive doll. The interactive doll may instruct the corresponding specific body part (514) of the interactive doll to respond by executing the operation corresponding to the control signal. In the voice control mode, the operations corresponding to the control signal may include making specified sounds, analyzing the voice control instruction and then carrying out a conversation, or respond by executing certain specified physical operations (e.g., waving an arm, turning the head, twisting the waist, and changing a position, etc.).

Preferably, the interactive doll may obtain feedback information generated according to a status of the executed operation corresponding to one or both of: the voice control information and the touch control information, which the interactive doll may generate to notify the user.

In an embodiment of the present disclosure, the interactive doll upon detecting that the control mode the user selects for the interactive doll may be the voice control mode, obtains the input voice control instruction containing the keyword voice segment, obtains voice control information corresponding to the keyword voice segment, and executes an operation corresponding to the voice control information. Control mode selection improves doll operability. Acquisition of voice control information corresponding to the keyword voice segment in the voice control mode enables more diversified interactive operations. In addition, the feedback information output further improves the interaction experience with the interactive doll.

FIG. 6 shows an exemplary structural diagram for another interactive doll (1B) provided by another embodiment of the present disclosure. FIG. 6 is similar to FIG. 5, except with the addition of: an instruction setting acquisition unit (14), a storage unit (15), an instruction monitoring unit (16), the information acquisition unit (17), an execution unit (18), and an information acquisition and output unit (19).

The instruction setting acquisition unit (14) may be configured to, when the mode monitoring unit detects that the selected control mode being a touch mode, obtain a touch control instruction by sensing a touch to a specific body part of the interactive doll (1B).

The storage unit (15) may be configured to store the at least one control instruction set corresponding to the at least one piece of control information; wherein, the at least one piece of control information contains a control signal which executes an operation to control a corresponding specific body part on the interactive doll (1B).

In actual condition, the instruction setting acquisition unit (14) may obtain at least one control instruction set corresponding to at least one piece of control information in the interactive doll, which the control instruction set being one or both of: the voice control instruction and the touch control instruction. The control information may contain a control signal (511) intended to interact with the interactive doll's body area (514) which executes the control signal (511). For each respective body area (514) and a corresponding control signal (511) of the interactive doll (1B), the user may define a corresponding control instruction. For example, a control instruction which instructs an interactive doll to make laughter sounds may be set by the user to a voice control instruction of "laugh"; and a control instruction which instructs an interactive doll to raise an arm may be set to respond to a touch control instruction of "Caress the interactive doll's head." The interactive doll (1B) may store the at least one control instruction and the at least one piece of control information.

It may be understood that, in the voice control mode, the interactive doll may respond to voice control instructions only; and in the touch mode, the interactive doll may respond to touch control instructions only. If in both the voice control and touch mode, the interactive doll may respond to both voice control instructions and touch control instructions. Control mode selection may meet users' individual needs, and thus conserve power consumption.

The mode monitoring unit (11) and instruction acquisition unit (12) have been described in detail in FIG. 5.

The information acquisition and execution unit (13) may be configured to obtain the voice control information corresponding to the keyword voice segment, and execute the operation corresponding to the control information. In actual implementation, the information acquisition and execution unit (13) obtains the voice control information corresponding to the keyword voice segment. The control information contains a control signal (511) intended for the interactive doll (1B) and the interactive body area (514) that executes the control signal (511). The information acquisition and execution unit (13) may instruct the interactive body area (514) to execute the operation corresponding to the control signal (511). In the voice control mode, the operations corresponding to the control signal include making sounds in a specified language, analyzing the voice control instruction and then having a conversation, and performing specified actions, for example, waving an arm, twisting the waist, and changing a position.

The information acquisition and execution unit (13) may be further configured to obtain the voice control information corresponding to the touched body area (514), and execute the operation corresponding to the control information.

The information acquisition and execution unit (13) obtains the voice control information corresponding to the touched body area (514). The control information contains a control signal (511) intended for the interactive doll (1B) and the interactive body area (514) that executes the control signal. The information acquisition and execution unit (13) may instruct the interactive body area (514) to execute the operation corresponding to the control signal (511).

In the touch mode, the operations corresponding to the control signal (514) include making specified sounds (for example, if the interactive doll's head may be touched, making sounds indicating shyness), performing the specified action (for example, waving an arm, twisting the waist, and changing a position), and warming an interactive body area (if an arm is touched).

It may be understood that a touched area of the interactive doll may be equipped with certain sensors (i.e., sensors in the sensing and control circuitry (515)), such as a temperature sensor, tactile sensor, pressure sensor, velocity sensor, humidity sensor, and gas sensor. Based on these sensors, the interactive doll may detect the body area (514) currently being touched by the user and obtain a current status of the user. For example, a gas sensor on the interactive doll (1B) may detect some odor of alcohol on the user, and therefore speak a sentence such as "stop drinking" or "enough, no more drinks".

In an embodiment, the touched specific body area (514) and the body area which responds to the touch sensor may be different areas. For example, when the head area of the interactive doll is touched (i.e., the sensor of the head detects a touch); the interactive doll's arms and waist (which are different body areas from the head area which is being touched) may be instructed to respond by performing the specified actions (such as moving the arms or the waist). Response adjustments may be made based on the instruction settings in the flow chart.

The instruction monitoring unit (16) may be configured to, when the mode monitoring unit (11) detects that the selected control mode being both voice control mode and touch control mode, monitor the control instruction input in the interactive doll (1B). In actual implementation, when the mode monitoring unit (11) detects that the control mode selected by the user being both voice control mode and touch control mode, the instruction monitoring unit (16) may further monitor the control instruction input in the interactive doll (1B);

The information acquisition unit 17 may be configured to, when the mode monitoring unit detects that the selected control mode being both voice control mode and a touch control mode, monitor respectively, the voice control instruction and a touch control instruction for input in the interactive doll.

In actual implementation, if the voice control instruction containing a keyword voice segment, the information acquisition unit (17) may obtain the voice control instruction containing a keyword voice segment and input in the interactive doll (1B), and obtains the voice control information corresponding to the keyword voice segment.

The information acquisition unit 17 may be further configured to, when the instruction monitoring unit (16) detects that the control instruction may be a touch control instruction sensing a touch to a specific body area (514) of the interactive doll (1B), obtain the voice control information corresponding to the touched body area (514).

If the control instruction may be a touch control instruction sensing a touch to a specific body area of the interactive doll 1, the information acquisition unit (17) may obtain the touch control instruction containing the touched area of the interactive doll (1B) and obtain the voice control information corresponding to the touched body area (514).

The execution unit (18) may be configured to execute a respective operation corresponding to the voice control information and the touch control information. In actual implementation, as control information contains a control signal (511) intended for the interactive doll (1B) and an interactive body area (514) that executes the control signal, the execution unit (18) may instruct the interactive body area to execute the operation corresponding to the control signal.

After the control information corresponding to a keyword voice segment may be received, the operations corresponding to the control signal include emitting specified sounds, analyzing the voice control instruction and then having a conversation, and performing specified actions, for example, waving an arm, twisting the waist, and changing a position.

In the touch mode, the operations corresponding to the control signal (514) include making specified sounds (for example, if the interactive doll's head may be touched, making sounds indicating shyness), performing the specified action (for example, waving an arm, twisting the waist, and changing a position), and warming an interactive body area (if an arm is touched).

It may be understood that a touched area of the interactive doll may be equipped with certain sensors (i.e., sensors in the sensing and control circuitry (515)), such as a temperature sensor, tactile sensor, pressure sensor, velocity sensor, humidity sensor, and gas sensor. Based on these sensors, the interactive doll may detect the body area (514) currently being touched by the user and obtain a current status of the user. For example, a gas sensor on the interactive doll (1B) may detect some odor of alcohol on the user, and therefore speak a sentence such as "stop drinking" or "enough, no more drinks".

In an embodiment, the touched specific body area (514) and the body area which responds to the touch sensor may be different areas. For example, when the head area of the interactive doll is touched (i.e., the sensor of the head detects a touch); the interactive doll's arms and waist (which are different body areas from the head area which is being touched) may be instructed to respond by performing the specified actions (such as moving the arms or the waist). Response adjustments may be made based on the instruction settings in the flow chart.

The information acquisition and output unit (19) may be configured to obtain the feedback information generated according to a status of the executed operation corresponding to one or both of: the voice control information and the touch control information, and outputting the feedback information.

In actual implementation, the information acquisition and output unit (19) may obtain the feedback information (512) that the interactive doll (1B) generates on the basis of the status of the operation corresponding to the control information and output the feedback information, notifying the user of the current status of the interactive doll (1B).

In the above embodiment of the present disclosure, the interactive doll upon detecting that the control mode the user selects for the interactive doll may be the voice control mode, obtains the input voice control instruction containing the keyword voice segment, obtains voice control information corresponding to the keyword voice segment, and executes an operation corresponding to the voice control information. Control mode selection improves doll operability. Acquisition of voice control information corresponding to the keyword voice segment in the voice control mode enables more diversified interactive operations. In addition, the feedback information (512) output further improves the interaction experience with the interactive doll.

Figure 7:
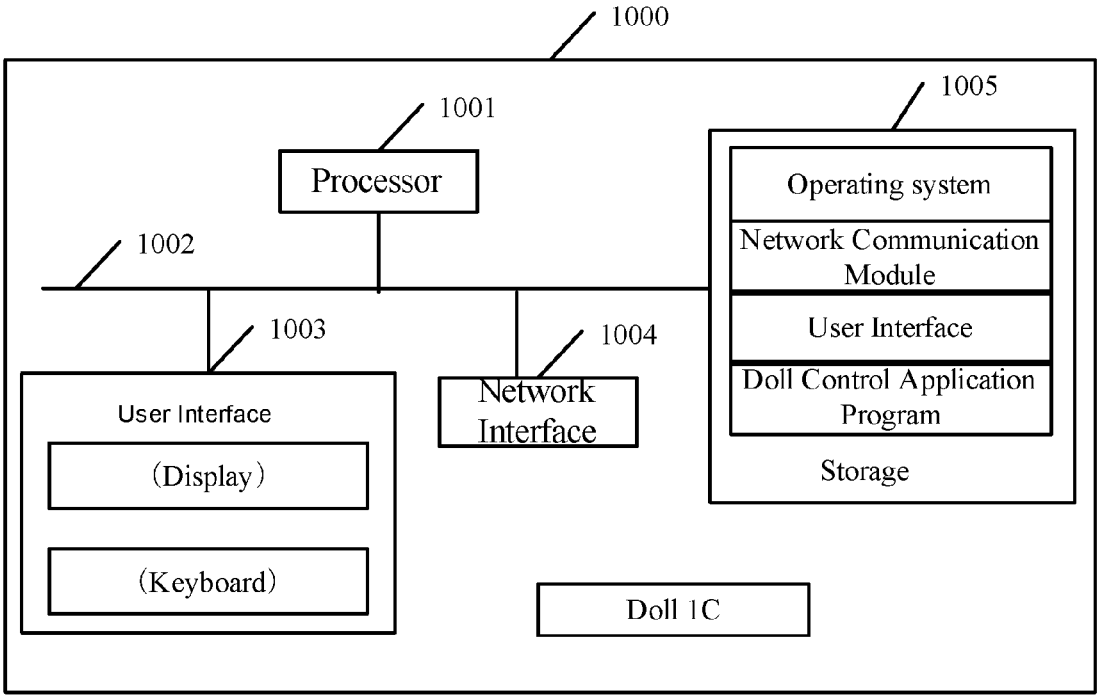
FIG. 7 shows an exemplary structural diagram of an interactive doll, according to yet another embodiment of the present disclosure.

FIG. 7 shows an exemplary structural diagram for yet another interactive doll (1000) according to another embodiment of the present disclosure. As shown in FIG. 7, the interactive doll (1000) may include at least one processor (1001), for example, a Central Processing Unit (CPU), at least one network interface (1004), a user interface (1003), a storage (1005), and at least one communication bus (1002).

The communication bus (1002) may be configured to complete the connection and communication among the above-mentioned components. The user interface (1003) may include a display and keyboard. Optionally, the user interface (1003) may also include a standard wired interface and wireless interface. The network interface (1004) may optionally include a standard wired interface and wireless interface, for example, a WIFI interface. The memory (1005) may be a high-speed random access memory (RAM) or nonvolatile memory, for example, at least one disk storage. The memory (1005) may optionally be a storage device far away from the processor (1001). As shown in FIG. 7, the memory (1005), as a computer storage medium, may store an operating system, network communication module, user interface module, and doll control application program.

In the interactive doll (1000) as shown in FIG. 7, the user interface (1003) may be mainly configured to provide input for the user and obtain the data output by the user; the processor (1001) may be configured to invoke the interactive doll control application program stored in the storage 1005 and execute the following steps: monitoring a control mode selected by a user for controlling the interactive doll; if the selected control mode being a voice control mode, obtaining a voice control instruction, wherein the voice control instruction contains one or more keyword voice segment as input control command to control the interactive doll; obtaining voice control information corresponding to the keyword voice segment, and executing an operation corresponding to the voice control information.

In an embodiment, the processor (1001) further executes the following steps: if the selected control mode being a touch mode, obtaining a touch control instruction by sensing a touch to a specific body part of the interactive doll; obtaining touch control information corresponding to sensing the touch to the specific body part of the interactive doll, and executing an operation corresponding to the touch control information.

In an embodiment, the processor (1001) further executes the following steps: if the selected control mode being both the voice control mode and a touch control mode, monitoring respectively, the voice control instruction and a touch control instruction for input in the interactive doll, and: if the voice control instruction containing a keyword voice segment, obtaining the voice control information corresponding to the keyword voice segment; if the control instruction is a touch control instruction sensing a touch to a specific body part of the interactive doll, obtaining touch control information corresponding to sensing the touch to the specific body part of the interactive doll; executing a respective operation corresponding to the voice control information and the touch control information.

In an embodiment, the processor (1001), before monitoring the control mode that the user selects for the interactive doll (1000), further executes the following steps: obtaining at least one control instruction set corresponding to at least one piece of control information configured in the interactive doll, the control instruction set being one or both of: the voice control instruction and the touch control instruction; storing the at least one control instruction set corresponding to the at least one piece of control information; wherein, the at least one piece of control information contains a control signal which executes an operation to control a corresponding specific body part on the interactive doll.

In an embodiment, when executing an operation corresponding to the touch control information, the processor (1001) specifically executes the following steps: instructing the corresponding specific body part of the interactive doll to respond by executing the operation corresponding to the control signal.

In an embodiment, the processor (1001) further executes the following steps: obtaining feedback information generated according to a status of the executed operation corresponding to one or both of: the voice control information and the touch control information; and outputting the feedback information.

The sequence numbers of the above-mentioned embodiments may be intended only for description, instead of indicating the relative merits of the embodiments. It should be understood by those with ordinary skill in the art that all or some of the steps of the foregoing embodiments may be implemented by hardware, or software program codes stored on a non-transitory computer-readable storage medium with computer-executable commands stored within. For example, the disclosure may be implemented as an algorithm as codes stored in a program module or a system with multi-program-modules. The computer-readable storage medium may be, for example, nonvolatile memory such as compact disc, hard drive. ROM or flash memory. The computer-executable commands may control an interactive doll.

What is claimed is:

1. An interactive doll control method, wherein a processor executing code stored in a memory to configure the interactive doll to perform operations, comprising:

monitoring a control mode selected by a user for controlling the interactive doll;

when the selected control mode being a voice control mode, obtaining a voice control instruction, wherein the voice control instruction contains one or more keyword voice segment as input control command to control the interactive doll;

obtaining voice control information corresponding to the keyword voice segment, and executing an operation corresponding to the voice control information, when the selected control mode being a touch mode, obtaining a touch control instruction by sensing a touch to a specific body area of the interactive doll;

obtaining touch control information corresponding to sensing the touch to the specific body area of the interactive doll, and executing an operation corresponding to the touch control information, wherein the operation being executed comprising causing the interactive doll to perform at least one of: gesturing with physical movements, a speech response non-verbal sound responses, and changing a temperature of certain body area of the interactive doll when touched; and wherein the interactive doll is equipped with an odor sensor, in response to sensing the touch to the specific body area of the interactive doll, further detecting by the odor sensor, certain odor of the interactive doll's surrounding when currently being touched, and causing the interactive doll to initiate a speech warning of the detection of the certain odor, wherein the speech warning is different from the speech response.

2. The interactive doll control method according to claim 1, further comprising:

when the selected control mode being both the voice control mode and a touch control mode, monitoring respectively, the voice control instruction and a touch control instruction for input in the interactive doll, and:

when the voice control instruction containing a keyword voice segment, obtaining the voice control information corresponding to the keyword voice segment;

when the control instruction may be a touch control instruction sensing a touch to a specific body area of the interactive doll, obtaining touch control information corresponding to sensing the touch to the specific body area of the interactive doll; and executing a respective operation corresponding to the voice control information and the touch control information.

3. The interactive doll control method according to claim 1, wherein before the step of monitoring the control mode selected by the user for controlling the interactive doll, further comprises:

obtaining at least one control instruction set corresponding to at least one piece of control information configured in the interactive doll, the control instruction set being one or both of: the voice control instruction and the touch control instruction;

storing the at least one control instruction set corresponding to the at least one piece of control information;

wherein, the at least one piece of control information contains a control signal which executes an operation to control a corresponding specific body area on the interactive doll.

4. The interactive doll control method according to claim 3, wherein the step of executing the operation to control the corresponding specific body area on the interactive doll, comprises:

instructing the corresponding specific body area of the interactive doll to respond by executing the operation corresponding to the control signal.

5. The interactive doll control method according to claim 1, further comprising:

obtaining feedback information generated according to a status of the executed operation corresponding to one or both of: the voice control information and the touch control information; and outputting the feedback information.

6. The interactive doll control method according to claim 1, wherein the interactive doll is a physical doll electronically programmed and controlled to perform physical actions to simulate one of: a helper, a nanny, a child, a baby, a security guard, a personal assistant, a companion, an adult toy, and a pet.

7. An interactive doll, comprises a doll figure having sensor circuitry embedded in relevant body areas for sensing or detection, wherein more than one relevant body areas are controlled by at least one processor with circuitry which executes program codes stored within at least a non-transitory computer readable memory medium which configures the interactive doll to:

monitor a control mode selected by a user for controlling the interactive doll;

in response to detecting that the selected control mode being a voice control mode, obtain a voice control instruction, wherein the voice control instruction contains one or more keyword voice segment as input control command to control the interactive doll;

obtain voice control information corresponding to the keyword voice segment, and execute an operation corresponding to the voice control information, detect that when the selected control mode being a touch mode, obtain a touch control instruction by sensing a touch to a specific body area of the interactive doll, obtain touch control information corresponding to sensing the touch to the specific body area of the interactive doll, and execute an operation corresponding to the touch control information, wherein the operation being executed comprising causing the interactive doll to perform at least one of: gesturing with physical movements, a speech response or non-verbal sound responses, and an instructed task; and wherein the interactive doll is equipped with an odor sensor, in response to sensing the touch to the specific body area of the interactive doll, further detect by the odor sensor, certain odor of the interactive doll's surrounding when currently being touched, and causes the interactive doll to initiate a speech warning of the detection of the certain odor, wherein the speech warning is different from the speech response.

8. The interactive doll according to claim 7, further configured to, when it is detected that the selected control mode being both voice control mode and a touch control mode, monitor respectively, the voice control instruction and a touch control instruction for input in the interactive doll;

when it is detected that the control instruction containing a keyword voice segment, obtain the voice control information corresponding to the keyword voice segment, when it is detected that the control instruction may be a touch control instruction sensing a touch to a specific body area of the interactive doll, obtain touch control information corresponding to sensing the touch to the specific body area of the interactive doll; and execute a respective operation corresponding to the voice control information and the touch control information.

9. The interactive doll according to claim 7, further configured to obtain at least one control instruction set corresponding to at least one piece of control information configured in the interactive doll, the control instruction set being one or both of: the voice control instruction and the touch control instruction;

store the at least one control instruction set corresponding to the at least one piece of control information;

wherein, the at least one piece of control information contains a control signal which executes an operation to control a corresponding specific body area on the interactive doll.

10. The interactive doll according to claim 9, configured to obtain the control signal corresponding to the keyword voice segment spoken to the interactive doll, and instruct the interactive doll to respond by executing the operation corresponding to the control signal;

alternatively, obtain the control signal corresponding to the specific body area of the interactive doll being touched, and instruct the corresponding specific body area of the interactive doll to respond by executing the operation corresponding to the control signal.

11. The interactive doll according to claim 9, configured to instruct the corresponding specific body area of the interactive doll to respond by executing the operation corresponding to the control signal.

12. The interactive doll according to claim 9, wherein the interactive doll is a physical doll electronically programmed and controlled to perform physical actions to simulate one of: a helper, a nanny, a child, a baby, a security guard, a personal assistant, a companion, an adult toy, and a pet.

13. The interactive doll according to claim 7, further configured to obtain feedback information generated according to a status of the executed operation corresponding to one or both of: the voice control information and the touch control information, and outputting the feedback information.

* * * * *